United States Patent [19]

White et al.

[11] Patent Number: 4,978,885

[45] Date of Patent: Dec. 18, 1990

[54] ELECTRON MULTIPLIERS WITH REDUCED ION FEEDBACK

[75] Inventors: Paul L. White, Sturbridge; Bruce N. Laprade, Holland, both of Mass.

[73] Assignee: Galileo Electro-Optics Corporation, Sturbridge, Mass.

[21] Appl. No.: 317,977

[22] Filed: Mar. 2, 1989

[51] Int. Cl.[5] ..... H01J 40/00

[52] U.S. Cl. ..... 313/103 CM; 313/105 CM; 313/103 R; 313/105 R; 313/528; 445/5; 445/13; 445/50; 445/51; 445/57

[58] Field of Search ..... 313/103 R, 103 CM, 104, 313/105 R, 105 CM, 528; 445/5, 6, 13, 46, 50, 51, 53, 57

[56] References Cited

U.S. PATENT DOCUMENTS

| | | | |
|---|---|---|---|
| 2,150,317 | 3/1939 | Clark | 250/175 |
| 2,586,771 | 2/1952 | Arditi et al. | 316/22 |
| 2,802,127 | 2/1954 | Dobischek et al. | 313/103 |
| 3,488,509 | 1/1970 | Goodrich | 313/103 R |
| 4,099,079 | 7/1978 | Knapp | 313/103 CM |
| 4,737,623 | 4/1988 | Uhl | 250/207 |

FOREIGN PATENT DOCUMENTS

| | | | |
|---|---|---|---|
| 7416247 | 5/1976 | France | 313/103 CM |
| 59-96642 | 6/1984 | Japan | 313/105 CM |

OTHER PUBLICATIONS

Timothy et al., "Multi-Anode Microchannel Arrays", 360 SPIE vol. 190 Optics Conference (1979) pp. 360–368.

J. G. Timothy, "Curved-Channel Microchannel Array Plates", Rev. Sci. Instrum. 52(8), pp. 1131–1142, Aug. 1981.

O. H. W. Siegmund, "Preconditioning of Microchannel Plate Stacks" SPIE Symposium, Feb. 7, 1989 pp. 3–10.

J. G. Timothy and R. L. Bybee, "Preliminary Results with Microchannel Array Plates Employing Curved Microchannels to Inhibit Ion Feedback", Rev.Sci. Instrum., vol. 48, No. 3, pp. 292–399, Mar. 1977.

*Primary Examiner*—Donald J. Yusko
*Assistant Examiner*—Michael Horabik
*Attorney, Agent, or Firm*—Watson, Cole, Grindle & Watson

[57] ABSTRACT

Reduced ion feedback in an electron multiplier (EM) is achieved by applying a higher than normal bias voltage to the EM and degassing the EM with a relatively high concentration of self-generated particles as a result of the applied bias voltage.

43 Claims, 6 Drawing Sheets

ELECTRON MULTIPLIERS WITH REDUCED ION FEEDBACK

BACKGROUND OF THE INVENTION

The invention relates to electron multipliers (EM), including continuous surface and discrete dynode multipliers and magnetic electron multipliers. In particular, the invention relates to channel electron multipliers (CEM) and CEM assemblies such as microchannel plates (MCP) which have reduced ion feedback.

Channel electron multipliers are tubular structures and are commonly fabricated from a special formulation of glass, which is heavily lead-doped. When properly processed, the glass exhibits useful secondary emissive and resistive characteristics.

Known CEMs exhibit end-to-end resistances in the range of $10^7$ to $10^9$ ohms. Electrical contacts, usually Nichrome, are deposited on both ends of the channel. This allows good electrical contact between an external voltage source and the CEM. The external voltage source serves a dual purpose. First, the channel wall replenishes its charge from the voltage source. Second, the applied voltage accelerates the low energy secondary electrons in the channel to a level where, upon collision with the surface, they create more secondary electrons. Electron multiplication or gain in excess of $10^8$ is possible with CEMs having an inside diameter of about 1 millimeter or less.

A straight channel electron multiplier 20 of the prior art is shown in FIG. 1. The CEM is a glass tube 21 whose interior surface acquires suitable resistive and secondary emissive properties through treatment of that surface which is sometimes referred to as a secondary emissive layer or interior surface. The ends of the multiplier 20 are coated with an electrode material 24 to which a high voltage potential 26 of a few thousand volts is applied. This operation should be performed in a vacuum of about $10^{-6}$ torr or better. Higher pressure operation increases the ion density in the channels which leads to specious electron pulses. High voltage should not be applied at pressures greater than $10^{-4}$ torr as electrical breakdown of the gas may occur. This usually results in a destroyed multiplier.

An incident particle 28, for example, an electron from an electron source 30 or a photon of sufficient energy is detected when it strikes the secondary emissive layer or interior surface of the CEM 20 and causes the emission of at least one secondary electron 34. The secondary electron 34 is accelerated by the electrostatic field created by the high voltage 26 within the channel 20 until it again hits the interior surface of the channel 20 as shown by the arrows. Assuming it has accumulated enough energy from the field, more secondaries 34 will be released. This process occurs ten (10) to twenty (20) times in a channel electron multiplier, depending upon its design and use, thereby resulting in a significant signal gain or cascade of output electrons 38.

It is of interest to note that the gain of the CEM 20 is not a function of channel length or diameter independently, but rather a function of the length-to-diameter ratio. It is this fact that allows considerable reduction in both length and diameter and hence the fabrication of very small arrays of CEMs called microchannel plates (MCP) which have channel dimensions approximately 100 times smaller than a typical CEM. Unless otherwise noted herein, the characteristics of CEMs and MCPs are similar except that the MCP has multiple channels.

Thus, the term channel electron multiplier or its abbreviation CEM is intended to include a microchannel plate.

A microchannel plate 40 illustrated in FIG. 2 begins as a glass tube filled with a solid, acid-etchable core which is drawn using fiber-optic techniques to form single fibers called mono-fibers. A number of these mono-fibers are then stacked in a hexagonal array called a multi. The entire assembly is drawn again to form multi-fibers. The multi-fibers are then stacked to form a boule or billet which is fused together at high temperature.

The fused billet is sliced on a wafer saw to the required bias angle, it is edged to size, and then ground and polished to an optical finish. The individual slice 42 is chemically processed to remove the solid core material, leaving a honeycomb structure of millions of tiny holes 44 which extend at an angle 48 between the faces 49 of the MCP. Each hole or channel 44 is capable of functioning as a single channel electron multiplier which is relatively independent of the surrounding channels.

Through subsequent processing, the interior surface 43 of each channel 44 in this specially formulated glass wafer 42 is given conductive and secondary emissive properties. Finally, a thin metal electrode 50 (usually Inconel or Nichrome) is vacuum deposited on the faces 49 of the wafer 42 to electrically connect all the channels 44 in parallel. High voltage 52 may then be applied across the MCP 40. The fragmented cross-sectional diagram in FIG. 2 illustrates the major mechanical components of all known microchannel plates.

MCPs may be fabricated in a wide variety of formats. The arrays may range in size from 6 millimeters to 150 millimeters or larger and they may be circular, rectangular or virtually any other shape as required by the application or instrument geometry.

For normal operation, a bias voltage 52 of up to about 1000 volts is applied across the microchannel plate 40, with the output at its most positive potential. The bias current flowing through the plate resistance is what supplies the electrons necessary to continue the secondary emission process. This process is similar to that which occurs in the single channel electron multiplier 20 (FIG. 1).

Straight CEMs and MCPs are unstable at gains in excess of $10^4$ in the sense that output pulses appear which are not directly caused by input photons or particle incidence. The primary reason for this instability is the phenomenon known as ion feedback which is schematically illustrated in FIG. 1. The number of electrons which move through the CEM 20 increases exponentially towards the output end 54. The same is true for an MCP. In this region, therefore, there is a high probability of ionizing some of the residual gas molecules within the channel 20, which ions 56 are illustrated schematically as an encircled plus sign.

Ion feedback is the process by which many of the residual gas molecules within the channel 20 become ionized by the intense electron flux which exists near the output end 54 of the channel 20. The ions 56 being positively charged are attracted or accelerated towards the input end 58 of the channel 20 due to the potential 26 applied to the device. The motion of the ions 56 is illustrated by dotted arrows. If these ions 56 acquire sufficient energy, secondary electrons 34' will result upon collision with the secondary emissive layer or interior surface of the channel. The ion induced secondary emissions 34' in turn cascade and multiply, leading to spurious output pulses which degrade the performance of the device.

In extreme cases a condition known as regenerative ion feedback or ion runaway can occur in which ion induced secondary electrons 34' multiply and continue to produce ions spontaneously without a primary input 28. In this condition, the device will continue to produce output events long after all input events 28 have stopped.

Ions 56' (and neutral molecules) which escape the channel may impinge on and adversely affect the electron source 30. For example, in a light intensification device the electron source 30 is a photocathode and the phenomenon is generally referred to as ion poisoning.

MCPs and CEMs can operate in two modes. In the first mode, known as the analog mode the electron multiplier is operated as a current amplifier. In this type of operation, the output current increases proportionally to the input current by the product of the gain factor. The output pulse height distribution is characterized by a negative exponential function.

FIG. 3 illustrates the principle by means of a plot which represents the number of pulses or pulse height distribution about an average gain G verses the gain of an analog CEM. A similar characteristic curve results with an MCP. The curve in FIG. 3 is known and is referred to in the art as a negative exponential.

The second mode of operation is known as the pulse counting mode. In this mode of operation the multiplier is operated at a sufficiently high input event level to drive the device into space charge saturation in which sufficient electron densities within the channel create inter-electron repulsive forces which limit the electron gain. The space charge saturation effect gives rise to an output pulse height distribution which is tightly fitted about a modal gain point. This pulse height distribution is approximated by Poisson statistics and is considered Gaussian.

FIG. 4 is a plot of the number of integrated output pulses verses gain in a CEM operating in the pulse counting mode. The plot shows that a pulse counting CEM, which operates at a higher gain, has an output pulse height that has a characteristic amplitude. FIG. 4 is known and is referred to as a Gaussian distribution. In contrast, the analog CEM has an output characteristic which varies widely.

There is an optimum voltage at which to operate a pulse counting CEM. FIG. 5 shows a typical plot of output count rate observed on a counter as a function of CEM applied voltage when the input signal is constant. The output count rate is observed to plateau as the CEM enters saturation (point A, approximately $10^8$ gain). For pulse counting it is desirable to operate the CEM about 50 to 100 volts above this point, i.e. at point B. Operation at voltages above this value does not increase the gain very much, but according to the prior art it can have detrimental effect on the device. First, the life of the CEM can be unnecessarily decreased. Second, when operating at voltages far in excess of those necessary for saturation, ion feedback may occur very early in the channel, resulting in noise pulse and possibly regenerative ion feedback. This phenomenon has traditionally been considered to have an extremely detrimental effect on the life and overall performance of CEMs and MCPs. Thus, the prior art has traditionally avoided those conditions which might result in an ion feedback and has particularly avoided the operation of MCPs and CEMs under conditions of regenerative ion feedback.

There are basically two methods for reducing ion feedback: firstly, ion blocking or trapping; secondly, prevention of ion formation. In the first method the probability of ions gaining enough energy or momentum to cause spurious noise is reduced by physical or electrical alteration of the channel. In general, ion trapping or blocking does not remove the source of ion feedback, namely the ions themselves. Ion elimination by the prevention of ion formation is clearly to be preferred.

One known method which greatly reduces ion feedback instability in CEMs and MCPs by ion trapping is a technique in which the channel or channels are curved. Curvature limits distance that an ion can travel towards the input end of the multiplier. Since the highest probability of generating ions exists near the output end of the channel and the distance toward the input that these ions can travel is limited, the gain of pulses due to these ions is very low in comparison to the overall gain of the device. Also, the lesser impact energy of these ions reduces the probability of secondary emission. Elimination of ion feedback allows electron multipliers of appropriate design to operate at gains in excess of $10^8$. Even though curved MCPs provide high gain without feedback, curved channel MCPs are difficult to manufacture and are expensive.

Some channel structures are modifications of the curved channel arrangement wherein the channel is helical. Such structures are difficult to produce with uniform characteristics and at reasonable cost.

Some channel structures distort the electric field causing the ions to be driven into the side wall of the channel before achieving sufficient momentum to initiate secondary emission. Such devices include ribbed channels, channels with a glass dike, or MCPs having bulk conductivity. These devices are likewise difficult and expensive to make and hard to control.

Another known method for trapping the ions employs two or more back to back MCPs in so-called Chevron TM or Z-stack arrangements. The plates are stacked in such a way that the bias angles of the channels in each adjacent MCP are at an angle to each other so that the ions produced in the output plate are prevented from being fed back to the input plate.

Another method of trapping the ions employs an ion barrier which is an ultra-thin membrane of silicon oxide $SiO_2$ or aluminum oxide $Al_2O_3$ formed on the input side of the plate which is opaque to ions, but is transparent to electrons of sufficient energy. Ion barriers effectively stop ion feedback to the photocathode. However, they do not address the problems of after pulses caused by ion feedback generated within the channel. Ion barriers may also adversely effect the signal to noise ratio of the plate because of the necessity to deliver higher energy incident or primary electrons to the plate which are capable of penetrating the film. The use of an ion barrier also necessitates operating the plate at a higher voltage to thereby provide higher energy primary electrons which higher voltage is not desirable. Collection efficiency is also reduced because most electrons scattered by the film between the channels have insufficient energy to thereafter penetrate the film and interchannel material to result in secondary emissions.

Ion formation is known to be diminished when the EM is operated under various high vacuum and high temperature conditions sometimes called a "bake" or "bake out" followed by electron bombardment degassing sometimes called "scrub": for example, less than $10^{-5}$ torr at 380° C., followed by electron scrubbing at an extracted charge rate of $6.6\times10^{-4}$ Q/cm$^2$ per hour for about 24–48 hours at room temperature. The process, employing a high vacuum and high temperature bake followed by room temperature electron bombardment degassing may occur over an extended period of time, for example, from a few hours to months. The so-called "bake and scrub" process in its various forms is time consuming and expensive to implement. In addition, a greater reduction in ion formation is desired.

SUMMARY OF THE INVENTION

In accordance with one aspect, the present invention comprises an electron multiplier (EM) which has been degassed by an ion scrubbing technique such that adsorbed contamination is sufficiently low so that ion feedback is negligible when the CEM is operating under normal conditions. The electron multiplier may be a channel electron multiplier (CEM), a microchannel plate (MCP) or a magnetic electron multiplier (MEM). According to the invention such devices may operate without exhibiting ion feedback.

The invention is also directed to a method for reducing ion feedback in an electron multiplier by operating the EM at an elevated voltage without an input. This operation is sufficient to substantially reduce regenerative ion feedback. In accordance with a closely related aspect of the invention, the high voltage applied to the EM may be reversed so that both ends of the EM may be degassed.

The electron multiplier degassed in accordance with the present invention exhibits various characteristics including an increased threshold for the onset of ion feedback; a change in the pulse distribution from negative exponential (analog mode) to gaussian (pulse counting mode) wherein a modal gain is observed and the full width at half maximum FWHM is narrowed.

DESCRIPTION OF THE PREFERRED EMBODIMENT

Figure 1:
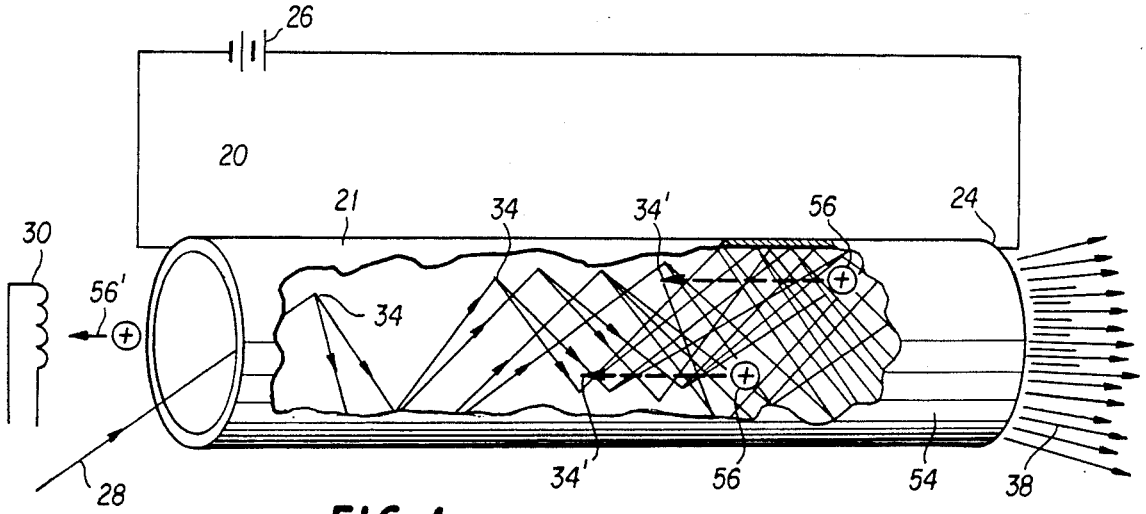
FIG. 1 is a fragmentary perspective of a straight channel electron multiplier of the prior art illustrating ion feedback.
Figure 2:
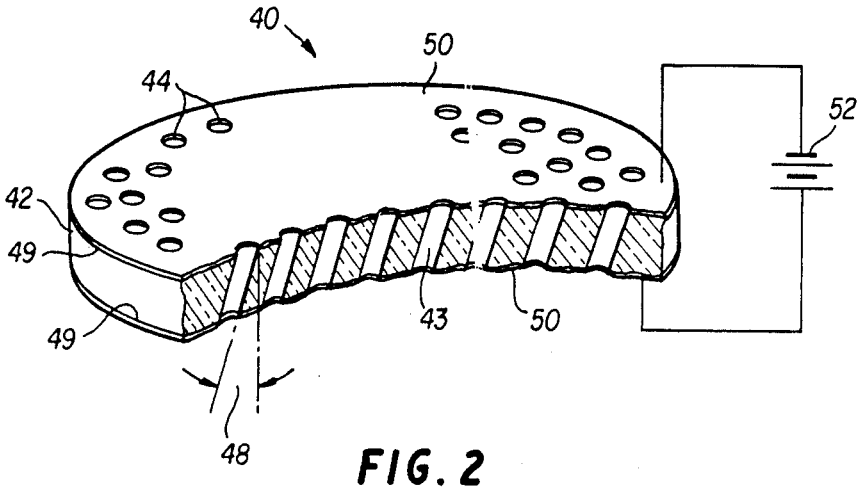
FIG. 2 is a fragmentary perspective of a microchannel plate MCP according to the prior art.
Figure 3:
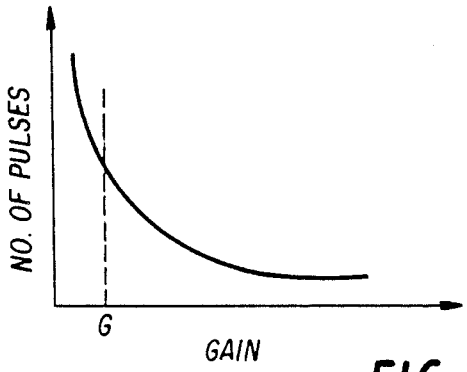
FIG. 3 is a typical plot of the number of input pulses verses gain for a CEM operating in the analog mode.
Figure 4:
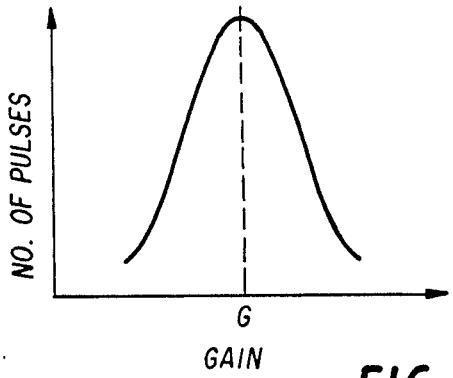
FIG. 4 is a typical plot of the number of input pulses verses gain for a CEM operating in the pulse counting mode (saturation)
Figure 5:
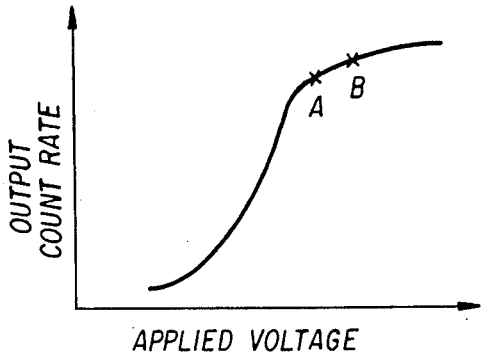
FIG. 5 is a typical plot of the observed output count rate with constant input verses voltage applied to a CEM.

According to the present invention, the electron multiplier is shown as MCP 80 (FIG. 6) mounted in a vacuum chamber 82 and biased by a high voltage source 84 which may be varied. Normally, depending upon the voltage level selected, a certain amount of ion feedback occurs in the channels of the MCP 80. For the MCP 80 illustrated, the voltage 84 applied thereto would, under normal circumstances, be selected to be less than that which would drive the MCP 80 into saturation, because such an operating condition would without more, result in self-sustained ion regeneration. According to the prior art, the only known way to avoid the effects of deleterious ion feedback is to trap or deflect the ions or degass channels. Self-sustained ion regeneration is avoided by maintaining the voltage 84 of the MCP 80 below the threshold for its onset.

According to a preferred embodiment of the present invention a new degassing technique is described which has the effect to avoid the necessity of trapping or deflecting ions in order to reduce ion feedback. The MCP 80 is loaded into the clean vacuum chamber 82 and is pumped down by pump 83 to at least $10^{-5}$ torr. The chamber 82 may be unheated and may operate at room temperature if desired. The bias voltage 84 across the MCP 80 is increased until a significant output current approximately 10% of the bias current is sustained. Preferably the bias voltage is increased, to a threshold value sufficient to drive the channels into self-sustained ion regeneration. This may be accomplished with or without an input stimulation. The evacuation pump 83 removes liberated ions 90 and neutral molecules from the chamber 82. The MCP 80 is operated under the condition described until the output current drops to significantly lower levels indicating that self-sustained ion regeneration has subsided. This occurs because once ions are liberated and evacuated they are no longer available to contribute to sustained secondary emission. If desired the bias voltage 84 may be increased to a threshold level sufficient to reinitiate self-sustained ion regeneration whereby more ions and/or neutral molecules may be liberated and evacuated. The process is considered complete when ion feedback is negligible at the desired operating conditions. For convenience, the process is sometimes hereafter referred to as ion scrubbing.

It is believed that one of the benefits of the present invention is that the relatively high biasing voltage which results in the onset of ion regeneration also causes an increase in the strip current, that is, the current for replenishing the electrons. The increased temperature (Joule heating) resulting from high strip current itself helps to drive off ions which in turn contribute to the regenerative ion feedback. Thus, in accordance with the present invention, the active surface of the channel which is to be degassed is self-heated and supplemental heating of the chamber 82 is not required to achieve satisfactory results.

Analysis of outgassed constituents during the scrubbing process according to the present invention is consistent with outgassed species resulting from prior art bake and scrub processing. However, the present invention results in much higher concentrations of removed constituents as evidenced by the improved performance hereafter described.

Figure 8:
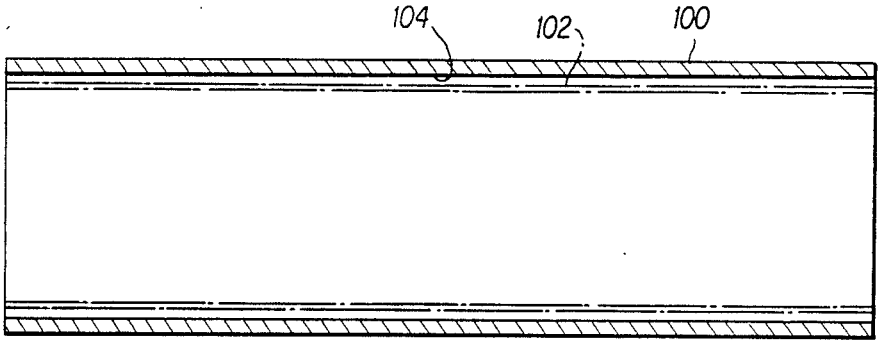
FIG. 8 is a schematic side sectional elevation of a CEM prior to undergoing degassing according to the present invention.
Figure 9:
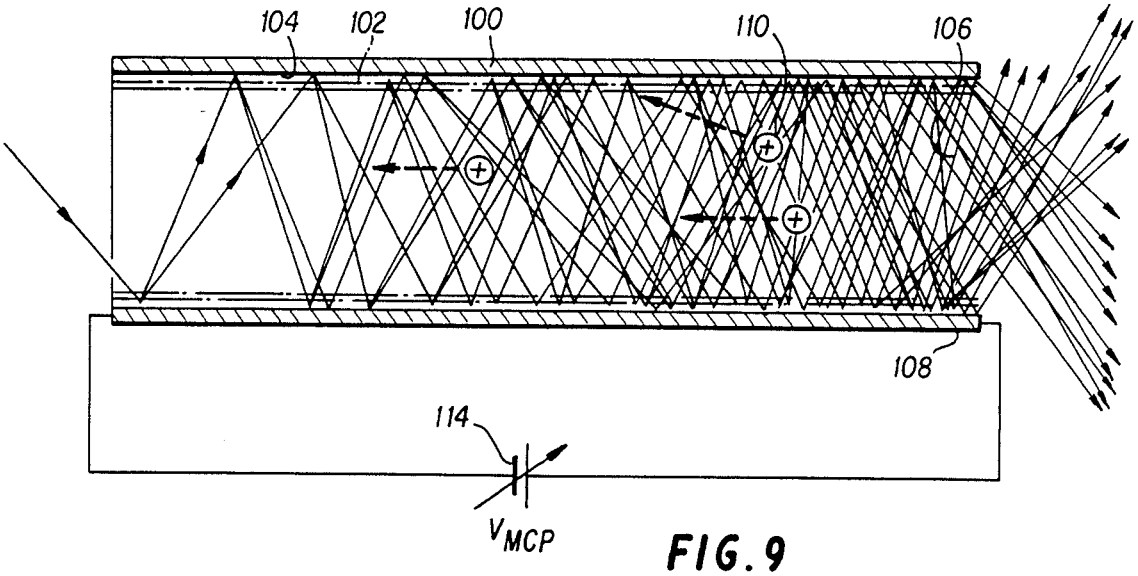
FIG. 9 is a schematic side sectional elevation of the CEM illustrated in FIG. 8 which is undergoing the process of degassing according to the present invention.
Figure 10:
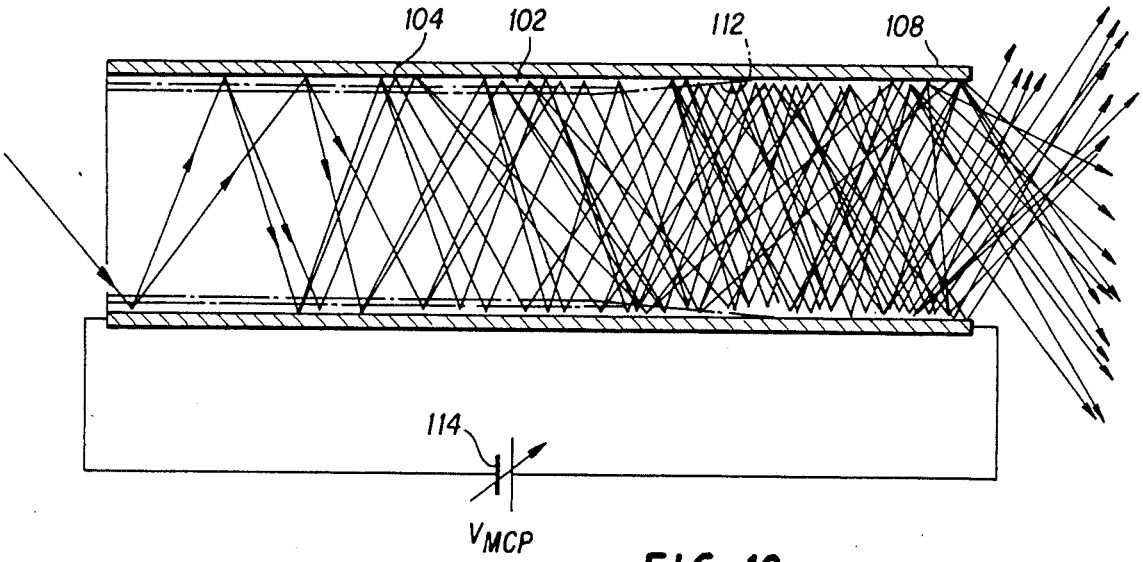
FIG. 10 is a schematic side sectional elevation of the CEM illustrated in FIG. 8 which has been degassed according to the present invention.

FIGS. 8–10 schematically illustrate the effect of the above described process. In FIG. 8 one channel 100 of an unscrubbed MCP is illustrated. The channel 100 has adsorbed ions 102 on or in its surface 104. In FIG. 9 the process is depicted in operation. It can be appreciated from the drawing as well as from knowledge of those skilled in the art that the high concentration of secondary emission 106 near the output end 108 of the channel 100 results in a high probability of liberation of ions 110. The probability increases exponentially in the direction of the output 108 where it is believed that most of the ions 110 liberated are produced. According to the invention, the self-sustained ion regeneration illustrated in FIG. 9 may be allowed to continue until sufficient ions 110 are liberated and removed so that ion regeneration is reduced to a negligible amount. FIG. 10 further illustrates the result of scrubbing according to the present invention. Notice that the ion layer 102 has a tapered surface 112 towards the output 108.

Figure 11:
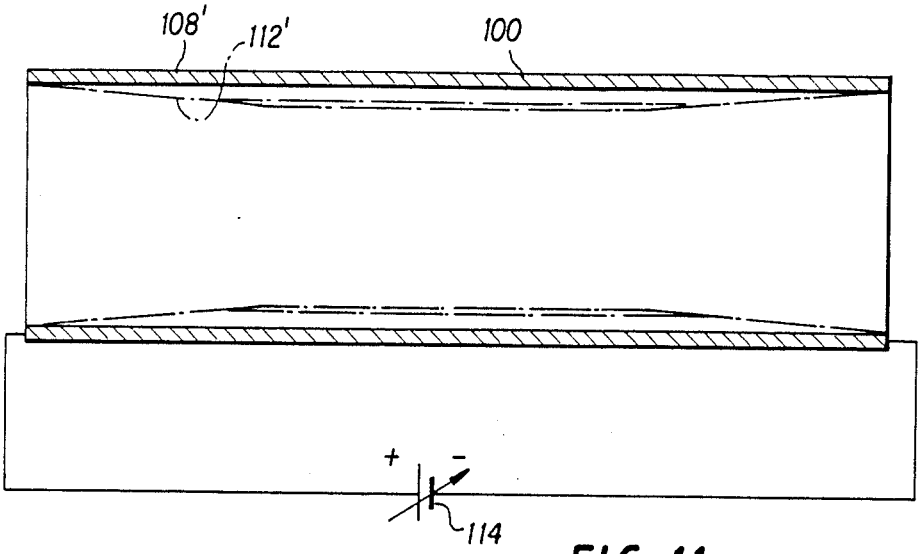
FIG. 11 is an illustration of another aspect of the present invention wherein both ends of a channel have been scrubbed.

In accordance with another closely related aspect of the present invention illustrated in FIG. 11, if the bias voltage 114 is reversed, as shown, and raised to a level above the threshold for self-sustained ion regeneration, ions will be liberated at the positively biased end 108' of the channel 100. If the process continues in the same manner as described with respect to FIGS. 8–10, the adsorbed ions 102 will have a profile 112' which is likewise tapered at the end 108'. Thus, the device may be used without regard for polarity.

It should be understood that the present invention is not limited to the aforementioned arrangement. Ions may be effectively and efficiently removed by the aggressive and severe scrubbing without necessarily maintaining the device in a condition of self-sustained ion regeneration. For example, effective scrubbing may be achieved by combining a high input flux of electrons with a higher than normal bias voltage in order to produce a very high density of secondary emissions within the EM nearly equivalent to self-sustained ion regeneration.

The scrub time may be varied in a variety of useful ways. First, the total scrub time may be significantly reduced with aggressive scrubbing from days to minutes. Second, it is clear from results obtained that, contrary to the prior art, the aggressive and severe scrubbing herein described may be sustained for many minutes without damaging the various devices.

The present invention also allows for simplified CEM or MCP configurations. For example, straight channel CEM or MCP may be manufactured which exhibits negligible ion feedback. Also a single stage MCP may be provided which exhibits negligible ion feedback.

The following examples are illustrative of results obtainable when an electron multiplier is prepared for processing in accordance with the teachings of the present invention.

EXAMPLE 1

Figure 6:
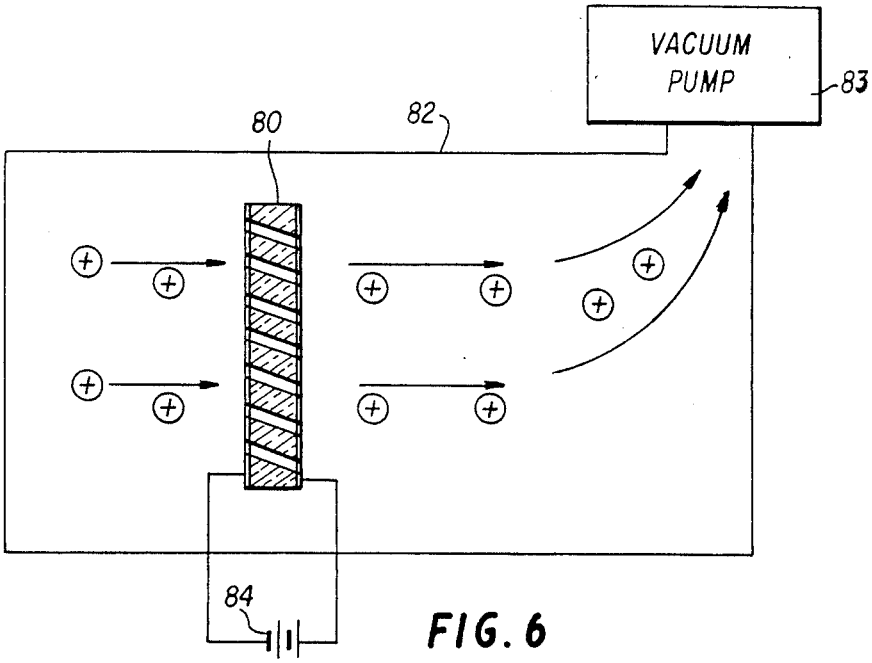
FIG. 6 is a schematic illustration of an apparatus for implementing the process of the present invention.
Figure 7:
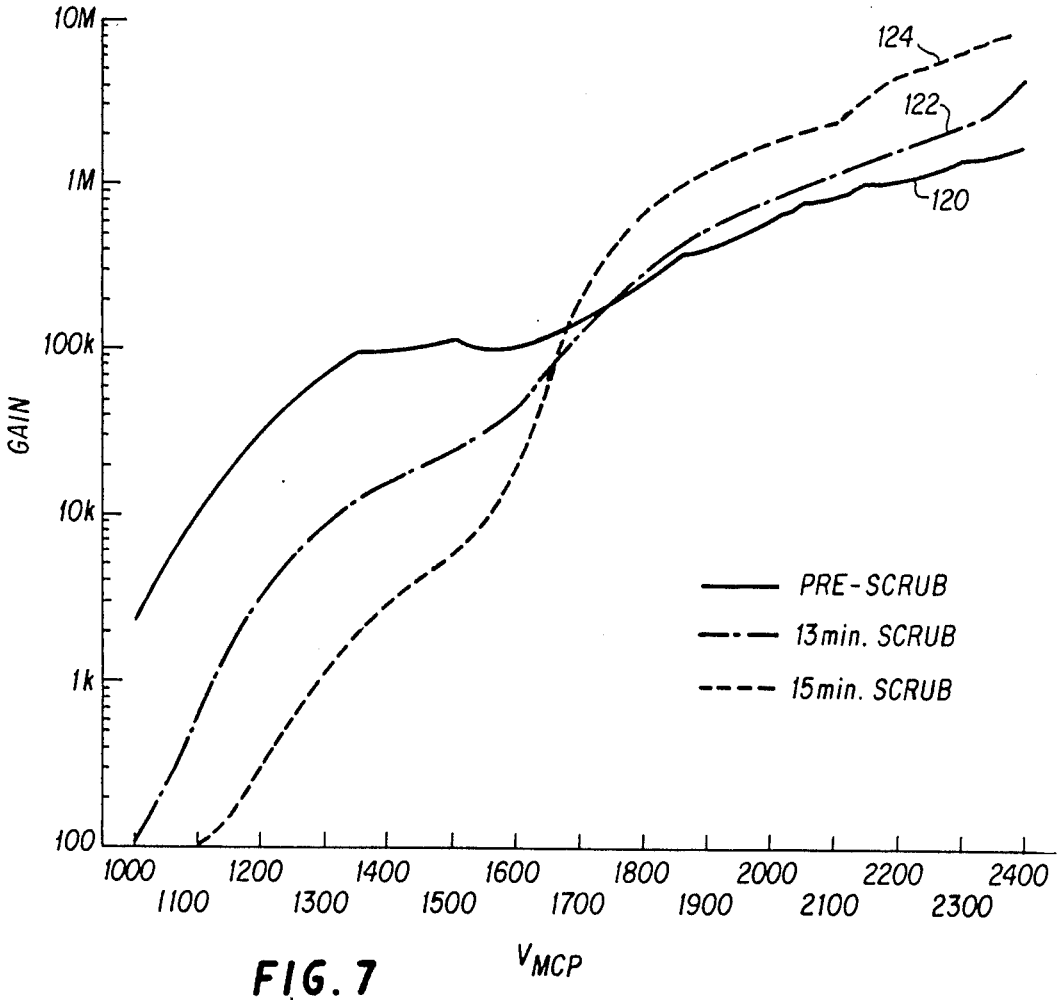
FIG. 7 is a plot similar to that shown in FIG. 5 and, in addition, response curves have been depicted which illustrate the characteristics of a device degassed according to the present invention.

Galileo Electro-Optics Hot TM MCP
5.5 megohm
80:1 l/d
40 mm overall diameter
15 micron center to center (c—c) spacing FIG. 7 illustrates in graphical form the results obtained for three treatments using an arrangement similar to that illustrated in FIG. 6 as follows: curve 120 represents the gain verses voltage applied to an untreated MCP; curve 122 represents a first treatment in accordance with the present invention for 13 minutes representing a charge integration of 0.3034 coulombs; and curve 124 represents a second treatment in accordance with the present invention for an additional 15 minutes (28 minutes total) with an additional charge integration of 0.4140 coulombs 0.7542 coulombs total).

The MCP 80 (FIG. 6) in an untreated condition was first operated at increasing voltages from 1000 to 2400 V. The gain verses voltage curve 120 (FIG. 7) illustrates the behavior of an unbaked and scrubbed MCP prior to treatment in accordance with the present invention. The results indicate a flattening out of the gain verses voltage curve 120 at around 1300 V followed by a steep increase at the inflection point above which the gain increases rapidly and self-sustained ion regeneration occurs with increasing voltages above 1300 V.

The MCP 80 in FIG. 6 was operated under conditions of self-sustained ion regeneration and high vacuum for 13 minutes without supplemental heating (i.e. baking). The results of such procedure are plotted in FIG. 7 as curve 122. The procedure was thereafter repeated for 15 minutes and the results are plotted as curve 124. The results indicate that, as expected, at the same voltage V (e.g. 1450 V), the gain G decreased with integrated charge. This means that ions were removed as a result of the process. It is also important to note that self-sustained ion regeneration did not destroy or deleteriously affect the performance of the MCP as was expected in the prior art. Also, in accordance with the present invention, the voltage threshold for the onset of ion feedback is elevated.

EXAMPLE 2

Table I shows the results achieved for the ion scrubbed MCP of Example 1 before and after a two week storage period in dry nitrogen.

Table II shows the data after the MCP was vented and stored for 16 days in laboratory air following the first two week period summarized in Table I and the process was repeated.

TABLE I

INITIAL AND SUBSEQUENT ION SCRUBBING OF AN MCP

| | QT = O Analog | QT = .726 | | QT = 1.731 | | 2 Week N2 Storage QT = O | | QT = .241 | | QT = 1.48 | |
|---|---|---|---|---|---|---|---|---|---|---|---|
| VMCP | GAIN | GAIN | FWHM | GAIN | FWHM | GAIN | FWHM | GAIN | FWHM | GAIN | FWHM |
| 1200 | $3.2 \times 10^4$ | — | NE | — | NE | — | NE | — | NE | — | NE |
| 1250 | $5.0 \times 10^4$ | — | NE | — | NE | $6.2 \times 10^4$ | 129 | — | NE | — | NE |

TABLE I-continued

| | INITIAL AND SUBSEQUENT ION SCRUBBING OF AN MCP | | | | | | | | | | |
|---|---|---|---|---|---|---|---|---|---|---|---|
| | QT = O Analog | QT = .726 | | QT = 1.731 | | 2 Week N2 Storage QT = O | | QT = .241 | | QT = 1.48 | |
| VMCP | GAIN | GAIN | FWHM | GAIN | FWHM | GAIN | FWHM | GAIN | FWHM | GAIN | FWHM |
| 1300 | $6.0 \times 10^4$ | — | NE | — | NE | $9.5 \times 10^4$ | 111 | $5.9 \times 10^4$ | 140 | $3.3 \times 10^4$ | 363 |
| 1350 | $9.5 \times 10^4$ | — | NE | — | NE | $1.2 \times 10^5$ | 97 | $9.4 \times 10^4$ | 144 | $7.5 \times 10^4$ | 117 |
| 1400 | $1.0 \times 10^5$ | — | NE | — | NE | IR | IR | $1.2 \times 10^5$ | 83 | $1.06 \times 10^5$ | 98 |
| 1450 | $1.1 \times 10^5$ | $6.6 \times 10^4$ | 84 | — | NE | IR | IR | $1.4 \times 10^5$ | 84 | $1.2 \times 10^5$ | 93 |
| 1500 | $1.2 \times 10^5$ | $8.3 \times 10^4$ | 72 | $7.7 \times 10^4$ | 69 | IR | IR | IR | IR | $1.5 \times 10^5$ | 90 |
| 1550 | $1.0 \times 10^5$ | $1.06 \times 10^5$ | 66 | $9.4 \times 10^4$ | 59 | IR | IR | IR | IR | $1.73 \times 10^5$ | 98 |
| 1660 | — | $1.2 \times 10^5$ | 66 | $1.1 \times 10^5$ | 70 | IR | IR | IR | IR | IR | IR |
| 1650 | — | IR | IR | $1.3 \times 10^5$ | 64 | IR | IR | IR | IR | IR | IR |
| 1700 | — | IR | IR | IR | IR | IR | IR | IR | IR | IR | IR |

NOTE:
NE = Negative Exponential
IR = Ion Runaway (Regenerated Ion Feedback)
— = No Saturated Gain Measurements
QT = Total Integrated Output Charge (Coulombs)

TABLE II

| | ION SCRUBBING OF MCP OF TABLE I AFTER SECOND STORAGE PERIOD | | | | | | | | | |
|---|---|---|---|---|---|---|---|---|---|---|
| | *QT = 1.48 | | After 16 Days Storage in Laboratory Air | | After .1722 QT | | After .5202 QT | | After 2.018 QT | |
| VMCP | Gain | FWHM | Gain | % FWHM | Gain | FWHM | Gain | FWHM | Gain | FWHM |
| 1200 | — | NE | — | NE | — | — | — | — | — | — |
| 1250 | — | NE | $5.6 \times 10^4$ | 133 | $2.7 \times 10^4$ | 284 | — | NE | — | NE |
| 1300 | $3.3 \times 10^4$ | 363 | $8.5 \times 10^4$ | 122 | $6.2 \times 10^4$ | 125 | $5.6 \times 10^4$ | 154 | $4.8 \times 10^4$ | 167 |
| 1350 | $7.5 \times 10^4$ | 117 | $1.06 \times 10^5$ | 109 | $9.1 \times 10^4$ | 113 | $8.8 \times 10^4$ | 114 | $7.9 \times 10^4$ | 124 |
| 1400 | $1.06 \times 10^5$ | 98 | IR | IR | $1.1 \times 10^5$ | 103 | $1.1 \times 10^4$ | 99 | $1.03 \times 10^5$ | 108 |
| 1450 | $1.2 \times 10^5$ | 93 | IR | IR | $1.32 \times 10^5$ | 107 | $1.3 \times 10^5$ | 103 | $1.2 \times 10^5$ | 102 |
| 1500 | $1.5 \times 10^5$ | 90 | IR | IR | $1.4 \times 10^5$ | 110 | $1.5 \times 10^5$ | 107 | $1.47 \times 10^5$ | 109 |
| 1550 | $1.73 \times 10^5$ | 98 | IR | IR | IR | IR | IR | IR | $1.6 \times 10^5$ | 115 |
| 1570 | IR | IR | IR | IR | IR | IR | IR | IR | $1.7 \times 10^5$ | 121 |
| 1650 | IR | IR | IR | IR | IR | IR | IR | IR | IR | IR |
| 1700 | IR | IR | IR | IR | IR | IR | IR | IR | IR | IR |

NE = Negative Exponential
QT = Total Integrated Output Charge (Coulombs)
*QT = 1.48 Since Last Vacuum Break (See Table I, Data Repeated Here)
IR = Ion Runaway
— = No Saturated Gain Measurements The maximum gain achievable without ion feedback increases with scrub time and the full width at half maximum (FWHM) narrowed. It was observed that a straight channel MCP operating in the saturation mode did not exhibit ion feedback. This phenomenon has not been observed in the prior art without modification to the structure of the MCP as hereinbefore described.

Table I also show the results of a subsequent ion scrubbing technique after the MCP was vented to air and stored in a nitrogen cabinet for two weeks. The results indicate that the MCP reabsorbed gases which caused gain per unit voltage to increase, the pulse height resolution was broadened and the threshold for ion runaway was lowered. Continued ion scrubbing brought the device back to nearly its original operating conditions after the first scrub. As illustrated in Table II, it appears that after repeated venting the phenomenon is reversible.

In another embodiment of the invention, it may also be possible, in view of the repeatability of the process, to operate an MCP in an entirely new way so that it becomes an ion source and/or an ion sink. The treatment according to the present invention removes wall surface layers from the electron multiplier. Thus, the wall surface becomes a source of ions while under intense bombardment. Also, the liberated ions not removed by evacuation may be permitted to be readsorbed by the clean wall surface layer when the intensity of the bombardment is terminated or reduced. Thus, the MCP becomes an ion sink. In such an arrangement the MCP could supply needed ions to another device on a controlled basis. Also the MCP could adsorb and store ions for use at a later time.

Figure 12:
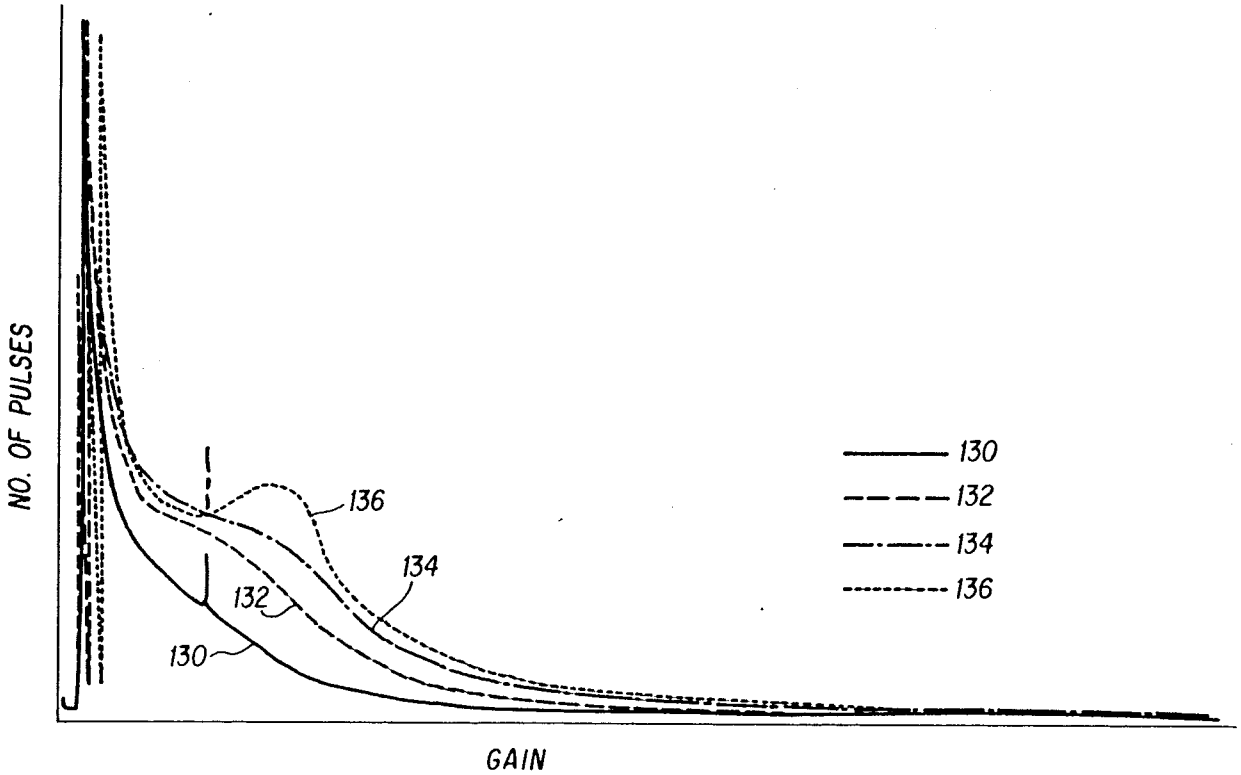
FIG. 12 is a series of four representative plots of pulse height verses gain of an EM illustrating changes in the characteristic pulse height distribution from a negative exponential (analog mode) (FIG. 3) to a gausian distribution (pulse counting mode) (FIG. 4) after degassing according to the present invention.

FIG. 12 illustrates four superimposed plots 130–134 which are illustrative of the results achieved before and after various periods of ion scrubbing. The plots 130–134 show a change from negative exponential (analog mode) to gaussian distribution (pulse counting mode), which occurs when an EM is processed in accordance with the teachings of the present invention. As illustrated, plot 130 is a negative exponential pulse height distribution for an untreated device. As ion scrubbing according to the present invention proceeds during successive time intervals represented by curves 132 and 134, saturation tendencies are observed, i.e. the average gain increases and the curves flatten. After additional ion scrubbing the device exhibits a strong gaussian pulse height distribution curve 136. Thus ion scrubbing of the present invention causes the pulse height resolution to move from a negative exponential 130 to a gaussian or normal distribution 136. The gain illustrated in curve 136 is sometimes referred to as a modal gain.

EXAMPLE 3

Simulated Bake and Scrub Cycle
Galileo Electro-Optics Corporation MCP
90 megohm

40:1 l/d
25 mm overall diameter
12 microns center to center (c—c) spacing
350 degree vacuum bake for 10 hours followed by electron degassing at room temperature using of electrons and setting the output of the MCP 10% of the bias current.
$10^{-7}$ torr. partial pressure Table III summarizes the results of a typical bake and electron scrub process in accordance with the prior art.

TABLE III

SIMULATED BAKE AND SCRUB COMPARATIVE DATA

| | AFTER VACUUM BAKE | | AFTER .067 QT ELECTRON SCRUB | |
|---|---|---|---|---|
| VMCP | GAIN | % FWHM | GAIN | % FWHM |
| 950 | — | NE | — | |
| 1000 | — | NE | — | NE |
| 1050 | $2.3 \times 10^4$ | 154 | — | NE |
| 1100 | $3.4 \times 10^4$ | 80 | — | NE |
| 1150 | $3.87 \times 10^4$ | 89 | $1.98 \times 10^4$ | 249 |
| 1200 | $4.56 \times 10^4$ | 105 | $3.39 \times 10^4$ | 112 |
| 1250 | $4.88 \times 10^4$ | 99 | $4.03 \times 10^4$ | 100 |
| 1300 | $5.32 \times 10^4$ | 102 | $4.88 \times 10^4$ | 76 |
| 1350 | $5.65 \times 10^4$ | 111 | $5.36 \times 10^4$ | 98 |
| 1400 | — | | $5.97 \times 10^4$ | 93 |
| 1450 | — | | $6.53 \times 10^4$ | 94 |
| 1500 | — | | $7.06 \times 10^4$ | 99 |
| 1550 | — | | IR | |

NOTE:
Vacuum bake 10 hrs @ 380° C., with heat up and cool down cycle 14 hrs - total: 24 hrs approximately followed by an electron scrub at room temperature for over 24 hours.
NE = Negative Exponential
IR = Ion Runaway (Regenerative Ion Feedback)
— = No Saturated Gain Measurements
QT = Total Integrated Charge The results in Table III indicate that at normal operating voltages below 1050 V the pulse height distribution of the MCP is a negative exponential. As the voltage increases 1050 V–1350 V, the distribution shows a slight tendency to move towards saturation. When the MCP is subjected to further degassing the maximum achievable gain between 1150 V–1500 V is increased, but does not reach $10^5$. The results of a simulated conventional bake and scrub (Table III) do not approach the performance achievable with procedure of the present invention. Note that high gains are not achieved and the time required to achieve the results tabulated require about over two days of processing. The present invention can achieve better results in a matter of minutes.

EXAMPLE 4

A Model 4039 pulse counting Galileo Electro-Optics Corp. Channeltron TM was fitted with an electrically isolated collector (EIC) which seals off the channel output side. A test circuit, including a cone at negative high voltage was set up with the channel output biased minus 200 volts. The EIC anode was then left at ground potential and connected to a Camberra charge sensitive preamplifier MLD 2005. The output of the preamplifier was fed to a series 35 multichannel analyzer. The pulse height distribution was recorded on an HP plotter.

TABLE IV

GAIN AND PULSE HEIGHT RESOLUTION FOR A 4039 PULSE COUNTING CEM BEFORE AND AFTER ION SCRUBBING IN EXAMPLE 4

| | BEFORE SCRUB | | AFTER 2 MIN ION SCRUB | | CHANGE IN |
|---|---|---|---|---|---|
| VCEM | GAIN | % FWHM | GAIN | % FWHM | GAIN |
| 2000 | $9.8 \times 10^5$ | 144 | $7.8 \times 10^5$ | 171 | −20% |
| 2050 | $1.8 \times 10^6$ | 82 | $1.2 \times 10^6$ | 100 | −33% |
| 2100 | $2.7 \times 10^6$ | 49 | $1.6 \times 10^6$ | 62 | −40% |
| 2150 | $3.4 \times 10^6$ | 33 | $1.8 \times 10^6$ | 43 | −47% |
| 2200 | | | $2.0 \times 10^6$ | 29 | |
| 2250 | | | $2.7 \times 10^6$ | 26 | |

The 4039 Channeltron TM was loaded into an oil free vacuum and evacuated to $2 \times 10^{-6}$ torr. A survey CEM sweep was taken indicating a saturated pulse height distribution onset at approximately 2 kilovolts. The 4039 was stimulated with ions from an ionization gauge located 14 inches from the input. The threshold for ion runaway was determined to occur at approximately 3500 volts with no input. However, in order to increase the scrub rate the voltage was increased to 3800 volts and the CEM was subjected to a two minute ion scrub and then reevaluated. Table IV illustrates the rapid decrease in gain following a short ion scrub with a narrowing of the pulse height resolution (FWHM). This data is consistent with that associated with the MCPs which were treated in accordance with the present invention and the 4771 described below in Example 6.

EXAMPLE 5

Using a procedure and test apparatus similar to Example 4, a model 4771 Channeltron TM Galileo Electro-Optics Corp. Analog CEM was tested for gain as a function of voltage. The device was subjected to an ion scrub by raising the operating voltage to 6 kilovolts and then lowering the voltage to 5 kilovolts for a sustained scrub period. It was noted that once the CEM had initially runaway, subsequent ion feedback episodes could be initiated at lower voltages. However, after an additional sustained period of ion scrubbing for 30 minutes the threshold for ion feedback began to increase.

EXAMPLE 6

Table V is a comparison of gain and FWHM for a Galileo Electro-Optics Corporation HOT TM MCP 40 mm, 80:1 L/D which was subjected to 2.081 coulomb total integrated charge scrub, maintained in a vacuum at $4 \times 10^{-6}$ torr. The gain and pulse height resolution (FWHM) was measured for various chamber pressures.

TABLE V

GAIN AS A FUNCTION OF CHAMBER PRESSURE

| $4.1 \times 10^{-6}$ Torr | $1.0 \times 10^{-5}$ Torr | $5.0 \times 10^{-5}$ Torr |
|---|---|---|

TABLE V-continued

GAIN AS A FUNCTION OF CHAMBER PRESSURE

| Vmcp | Gain | FWHM | Gain | FWHM | Gain | FWHM |
|---|---|---|---|---|---|---|
| 1250 | — | NE | — | NE | — | NE |
| 1300 | — | NE | — | NE | $4.7 \times 10^4$ | 169% |
| 1350 | $8.58 \times 10^4$ | 103% | $8.43 \times 10^4$ | 85% | $8.43 \times 10^4$ | 108% |
| 1400 | $1.09 \times 10^5$ | 74% | $1.09 \times 10^5$ | 73% | $1.06 \times 10^5$ | 78% |
| 1450 | $1.32 \times 10^5$ | 64% | $1.32 \times 10^5$ | 65% | $1.31 \times 10^5$ | 71% |
| 1480 | — | — | — | — | $1.47 \times 10^5$ | 66% |
| 1500 | $1.57 \times 10^5$ | 57% | $1.55 \times 10^5$ | 57% | IR | IR |
| 1520 | $1.61 \times 10^5$ | 57% | $1.63 \times 10^5$ | 59% | IR | IR |

NE = Negative Exponential
IR = Ion Runaway

The results show that over the pressure range $4.1\times10^{-6}$–$5\times10^{-5}$ torr there is little effect or gain. However, FWHM broadens about 5–6% and the threshold for ion-feedback is lowered when the pressure is raised to $5\times10^{-5}$ torr.

TABLE VI

COMPARATIVE SCRUB RATE DATA CALCULATED FOR VARIOUS MCP DEVICES

| Item | Device L/D | $V_{mcp}$ V | Strip Current Density $I_s$/s μa/cm² | Power W | Calculated Scrub Rate Extracted Q/cm²/h |
|---|---|---|---|---|---|
| 1 | 40:1 (Std) | 1000 (DSL) | 1.85 | .01 | $6.6 \times 10^{-4}$ |
| 2 | 80:1 (Std) | 1000 (DSL) | 1.85 | .01 | $6.6 \times 10^{-4}$ |
| 3 | 40:1 (HOT TM) | 1000 (DSL) | 130.0 | .702 | $4.6 \times 10^{-2}$ |
| 4a | 40:1 (Std) | 1300 (IR) | 2.41 | .017 | $8.6 \times 10^{-4}$ |
| 4b | 40:1 (Std.) | 1300 (IR) $I_o = .5I_s$ | 2.41 | .017 | $4.3 \times 10^{-3}$ |
| 4c | 40:1 (Std.) | 1300 (IR) | 2.41 | .017 | $8.6 \times 10^{-3}$ |
| 5a | 40:1 (HOT TM) | 1300 (IR) | 169.52 | 1.18 | $6 \times 10^{-2}$ |
| 5b | 40:1 (HOT TM) | 1300 (IR) $I_o = .5I_s$ | 169.52 | 1.18 | $3 \times 10^{-1}$ |
| 5c | 40:1 (HOT TM) | 1300 (IR) $I_o = I_s$ | 168.52 | 1.18 | $6 \times 10^{-1}$ |

Temperature 3, 5a–5C exhibit self-heating due to High $I_s$
Std = *Standard MCP*
HOT *TM* = *High Output Technology MCP*
DSL = *DC Stability Limit*
IR = *Ion Regeneration*
$I_s$ = Strip Current
$I_o$ = Output Current
W = watts
V = volts
Q = coulombs
a = ampers
h = hours
S = MCP area = 5.4 cm²
cm² = square centimeters
Power = $I_s \times V_{mcp}$
Scrub Rate = $_{\mu o}$/s × 3600 sec/hr
All MCPs are radiatively cooled
Unless otherwise noted:
$I_o = .1\ I_s$ max The results in Table VI show the calculated scrub rate based upon area for a variety of devices treated in accordance with the present invention. The calculated results indicate that, according to the invention, significantly higher scrub rates may be implemented to effectively remove ions from the EM surface. For example, a severe scrub for about between 15 minutes to 1 hour at a scrub rate of on the order of about between $10^{-1}$ and $10^{-4}$ coulombs/cm²/hr may be sufficient to achieve a modal gain. While longer scrub times and higher scrub rates are possible, the scrub rates and scrub times outlined above result in a workable single stage, straight channel device in which ion feedback is effectively eliminated. The performance of such devices is comparable with curved channel MCP's and at much lower cost both in terms of fabrication of a curved channel MCP and cleanup associated with conventional bake and scrub and burn in processes.

The treatment in accordance with the present invention reduces scrub times from 24–48 hours to minutes. Also, the present invention effectively provides more effective device stabilization than current bake and scrub procedures. The invention also results in a device having a stable counting plateau at greatly reduced cost.

While the invention has been described in connection with specific embodiments thereof, it will be understood that it is capable of further modifications. This application is intended to cover any variations, uses or adaptations of the invention following, in general, the principles of the invention, and including such departures from the present disclosure as come within known and customary practice within the art to which the invention pertains.

What is claimed is:

1. An electrical device comprising:

an electron multiplier having been scrubbed by the impact of particles thereon resulting from operating the EM at an applied voltage sufficient to result in the onset of self-sustained ion regeneration for a time sufficient to result in an effective termination of the self-sustained ion regeneration such that thereafter ion feedback is negligible when the EM is operated up to said applied voltage.

2. The device of claim 1 wherein the EM is subjected to an applied voltage sufficient to drive the electron multiplier into saturation.

3. The device of claim 1 wherein the EM is subjected to an applied voltage sufficient to cause a strip current to flow which produces self-heating in the electron multiplier.

4. The device of claim 1 wherein the impact of particles occurs at a rate of bombardment of about $10^{-4}$ coulombs per square centimeter per hour.

5. The device of claim 1 wherein the impact of particles occurs at a rate of bombardment of about between $10^{-4}$ and $10^{-1}$ coulombs per square centimeter per hour.

6. The device of claim 1 wherein the impact of particles is sustained for a time sufficient to result in negligible ion feedback at a desired operating voltage less than the applied voltage resulting in self-sustained ion regeneration.

7. The device of claim 1 wherein the impact of particles is sustained for about 15 minutes.

8. The device of claim 1 wherein the impact of particles is sustained from about 15 minutes to about an hour.

9. The device of claim 1 wherein the EM is subjected to an applied voltage sufficient to result in a strip current flowing therein and an output current which is about 10% of the strip current.

10. The device of claim 1 wherein after scrubbing the EM is subjected to an increase in its applied voltage sufficient to re-initiate the onset of self-sustained ion regeneration.

11. The device of claim 1 wherein the EM is subjected to an applied voltage sufficient to cause the electron multiplier to operate at about 0.1 watt/cm$^2$.

12. The device of claim 1 wherein the electron multiplier comprises a channel electron multiplier.

13. The device of claim 11 wherein the channel electron multiplier has a straight channel.

14. The device of claim 1 wherein the electron multiplier is a microchannel plate.

15. The device of claim 14 wherein the microchannel plate has straight channels.

16. The device of claim 15 wherein the microchannel plate is a single stage device.

17. The device of claim 14 wherein the straight channel microchannel plate has the performance of a curved channel microchannel plate.

18. The device of claim 1 wherein the EM is subjected to an applied voltage greater than about 50 volts above a point at which the observed output count rate with a constant input levels off.

19. The device of claim 1 wherein after scrubbing the EM exhibits a gaussian pulse height distribution.

20. The device of claim 1 wherein the pulse height distribution of the EM changes from a negative exponential to a gaussian function.

21. The device of claim 1 wherein after scrubbing the gain of the EM is stable.

22. The device of claim 1 in which formation of ions within the EM is reduced by the removal of wall surface layers from which said ions are liberated by the impact of the particles.

23. The device of claim 22 wherein the surface layers are reversibly replenished upon exposure to ions.

24. The device of claim 22 wherein the EM is a source of ions during scrubbing and a sink for ions after scrubbing.

25. The device of claim 22 in which said removal is manifested by the effective or virtual elimination of regenerated electron pulses initiated by acceleration and subsequent impacts of ions formed from said layers.

26. The device of claim 1 wherein after scrubbing, the EM operates at a stable counting plateau.

27. The device of claim 1 wherein the impact of particles occurs at a rate of bombardment which is a function of the length of the electron multiplier.

28. The device of claim 1 wherein the EM is operated under forward and reverse bias operating voltages.

29. The device of claim 1 wherein self-sustained ion regeneration occurs without an input of particles into the EM.

30. The device of claim 1 wherein the applied voltage is applied in a selected positive and negative polarity between ends of the EM and scrubbing occurs primarily in a region of the EM near the positive end.

31. The device of claim 1 wherein the self-sustained ion regeneration occurs without resulting damage to the EM.

32. The device of claim 1 wherein after scrubbing the achievable gain of the EM is increased.

33. A method for scrubbing an electron multiplier by the impact of particles thereon comprising the step of applying a voltage on the EM sufficient to result in the onset of self-sustained ion regeneration, and maintaining said applied voltage for a time sufficient to result in effective termination of said self-sustained ion regeneration such that thereafter ion feedback is negligible when the EM is operated up to said applied voltage.

34. The method of claim 33 wherein the step of applying a voltage includes self-heating active surfaces of the EM.

35. The method of claim 34 in which self-heating occurs by joule heating.

36. The method of claim 32 further including the step of reversing the applied voltage of the electron multiplier.

37. The method of claim 33 including saturating the electron multiplier.

38. The method of claim 33 including operating the EM at saturation without ion feedback.

39. The method of claim 33 wherein the EM has a straight channel and is operable in saturation without ion feedback.

40. The method of claim 33 further including the step of reversibly liberating ions during said impacting of particles.

41. The method of claim 33 further comprising the step of absorbing ions when the EM is not operating above the applied voltage.

42. The method of claim 33 wherein the applied voltage is about between 1000 v and 600 v.

43. The method of claim 33 wherein the applied voltage is about 1300 v.

* * * * *